US007478767B2

(12) United States Patent
Wu

(10) Patent No.: US 7,478,767 B2
(45) Date of Patent: Jan. 20, 2009

(54) APPARATUS FOR REGULATING FLUID FLOW THROUGH A SPRAY NOZZLE

(75) Inventor: Jao Wu, Lidcombe (AU)

(73) Assignee: Engineering Vortex Solutions Pty. Ltd., Regents Part, NSW (AU)

( * ) Notice: Subject to any disclaimer, the term of this patent is extended or adjusted under 35 U.S.C. 154(b) by 0 days.

(21) Appl. No.: 10/524,350

(22) PCT Filed: Aug. 15, 2003

(86) PCT No.: PCT/AU03/01032

§ 371 (c)(1),
(2), (4) Date: Sep. 30, 2005

(87) PCT Pub. No.: WO2004/016358

PCT Pub. Date: Feb. 26, 2004

(65) Prior Publication Data

US 2006/0102748 A1 May 18, 2006

(30) Foreign Application Priority Data

Aug. 15, 2002 (AU) ..... 2002950802

(51) Int. Cl.
*B05B 1/34* (2006.01)

(52) U.S. Cl. ..... 239/472; 239/468; 239/463; 239/478; 239/487; 239/499; 137/812

(58) Field of Classification Search ..... 239/405, 239/421, 423, 426, 434.5, 400, 416.1, 427, 239/427.3, 403, 468, 472, 463, 499, 504
See application file for complete search history.

(56) References Cited

U.S. PATENT DOCUMENTS 1,826,776 A * 10/1931 Gunther ..... 239/8
1,874,970 A * 8/1932 Hall ..... 239/403

(Continued)

FOREIGN PATENT DOCUMENTS

WO 95/23029 8/1995

OTHER PUBLICATIONS

PCT International Search Report dated Nov. 19, 2004.

(Continued)

*Primary Examiner*—Dinh Q Nguyen
(74) *Attorney, Agent, or Firm*—McCarter & English, LLP

(57) ABSTRACT

An apparatus for regulating fluid flow through a spray nozzle comprising a circular chamber (1) defined by spaced apart end walls, a peripheral side wall (3), a central axis, and a first inlet at or near the peripheral side wall (3) to allow a flow of fluid to enter said chamber (1) tangential to the peripheral side wall (3), and an outlet (4) exiting through one of the end walls. In use a flow of fluid entering through the first inlet has a primary lower layer (16) that follows a first circular flow path which forms a vortex commencing at the peripheral side wall (3) and increases in velocity and pressure towards the outlet and at least one secondary upper layer (17) that substantially follows a second flow path radially inwardly towards the central axis. The primary lower layer (16) and the secondary upper layer (17) interact and support each other over at least a portion of flow between the inlet and outlet (4).

11 Claims, 5 Drawing Sheets

U.S. PATENT DOCUMENTS

| | | | | | |
|---|---|---|---|---|---|
| 2,080,264 | A | | 5/1937 | Gray | |
| 3,070,317 | A | * | 12/1962 | Hunter et al. | 239/402 |
| 3,195,303 | A | * | 7/1965 | Widell | 60/231 |
| 3,324,891 | A | * | 6/1967 | Rhoades | 137/812 |
| 4,109,869 | A | | 8/1978 | Brockelsby | |
| 4,331,294 | A | | 5/1982 | Gilad | |
| 4,426,041 | A | | 1/1984 | Nieuwkamp et al. | |
| 4,698,014 | A | * | 10/1987 | Grethe et al. | 431/9 |
| 4,796,815 | A | | 1/1989 | Greenberg | |
| 5,054,474 | A | * | 10/1991 | Jacob et al. | 601/160 |
| 5,112,498 | A | * | 5/1992 | Davies | 210/708 |
| 5,197,517 | A | * | 3/1993 | Perera | 137/813 |
| 6,161,782 | A | | 12/2000 | Heinbuck et al. | |
| 6,343,750 | B1 | | 2/2002 | Engel | |
| 6,415,993 | B1 | * | 7/2002 | Forbert et al. | 239/434 |

OTHER PUBLICATIONS

Supplementary European Search Report (Sep. 24, 2007) (single page).

* cited by examiner

APPARATUS FOR REGULATING FLUID FLOW THROUGH A SPRAY NOZZLE

TECHNICAL FIELD

This invention relates to apparatus for regulating fluid flow utilising an improved way of combining different flow conditions to increase and economise the spraying (jet output) and mixing effects of a spray nozzle. More particularly, the invention is described, with reference to a water-saving shower head. However, the present invention is not restricted to shower head applications and is applicable to other fluidic applications involving liquid and/or gaseous fluid flows.

BACKGROUND

In order to conserve water it is common practice to install water saving shower heads. The devices currently used for this are quite rudimentary in operation. They typically reduce consumption by employing a small inlet to the shower head to reduce flow. The volume of water emanating from the head may also be decreased, simply by using reduced diameter spray holes. While each of these designs are to some extent successful, their effectiveness is limited because a reduction in flow rate also reduces the pressure of the spray. Consequently shower heads which operate at the current benchmark of 9 litres per minute for an AAA rating have problems with low spray pressure, restricted spray patterns and clogging of the outlet holes in the spray head. Also, for many people a shower spray of 9 litres per minute from existing devices feels inadequate.

One way of economising on flow rate whilst maintaining a desirable spraying effect is to have the primary flow of water entering the shower head chamber tangentially through an inlet in its peripheral side wall that is constrained to follow a circular flow path, and exits at an outlet in an end wall at or near the central axis of the chamber. This primary flow of water that follows a circular path forms a vortex commencing internally at or near the peripheral side wall and increases in velocity and pressure towards the outlet. If a further inlet is provided at substantially 90 degrees to the circular flow path and a secondary control flow of water is fed through this further inlet it regulates and atomizes the primary flow into a spray that emanates from the outlet.

This method of atomising and forming a spray is not limited to water applications and is employed in uses involving other fluids. One such application is in a fuel injection valve where atomisation of the fuel is desirable. U.S. Pat. No. 6,161,782 (Heinbuck et al.) depicts a fuel atomising disk in FIG. 2, in which a secondary control flow is provided at substantially 90 degrees to the primary circular flow path, and regulates and atomises the primary flow into a spray.

A disadvantage of providing a secondary control flow at substantially 90 degrees to the primary circular flow (or vortex) path, is that it tends to interfere and break down the vortex.

SUMMARY OF INVENTION

According to a first aspect the invention consists of an apparatus for regulating fluid flow through a spray nozzle, said apparatus comprising a circular chamber defined by spaced apart end walls, a peripheral side wall, a central axis, at least a first inlet at or near said peripheral side wall to allow a flow of fluid to enter said chamber substantially tangential to said peripheral side wall, an outlet exiting through one of said end walls characterised in that in use a flow of fluid entering through said first inlet has a primary lower layer that substantially follows a first circular flow path which forms a vortex commencing at or near said peripheral side wall and increases in velocity and pressure towards said outlet and at least one secondary upper layer that substantially follows a second flow path radially inwardly towards said central axis, said primary lower layer and said secondary upper layer interact and support each other over at least a portion of flow between said inlet and said outlet.

Preferably said second flow path of said secondary upper layer is generated by means for generating an inwardly radial flow.

Preferably said apparatus comprises a disc engagable with a spray nozzle housing that in combination define said circular chamber, and one of said spaced apart end walls and said peripheral side wall of said circular chamber form part of said disc, and said means for generating an inwardly radial flow is a narrow annular gap between said disc and said housing, said annular gap being disposed radially outwardly relative to said peripheral side wall.

In one embodiment the volume of said annular gap is fixed.

In another embodiment the volume of said narrow gap is variable by movement of said disc relative to said spray nozzle housing along said centrally located housing.

In one embodiment said outlet is located at or near said centrally located axis.

Preferably said at least first inlet is a plurality of inlets.

Preferably in one embodiment the one of said spaced apart end walls that forms part of said disc has a substantially flat portion.

Preferably in another embodiment the one of said spaced apart end walls that forms part of said disc has at least one substantially curved portion.

In a further embodiment said apparatus is used to mix different fluids.

BRIEF DESCRIPTION OF THE DRAWINGS

The currently preferred embodiments of the invention will now be described with reference to the attached drawings in which.

BEST MODE OF CARRYING OUT INVENTION

Figure 1:
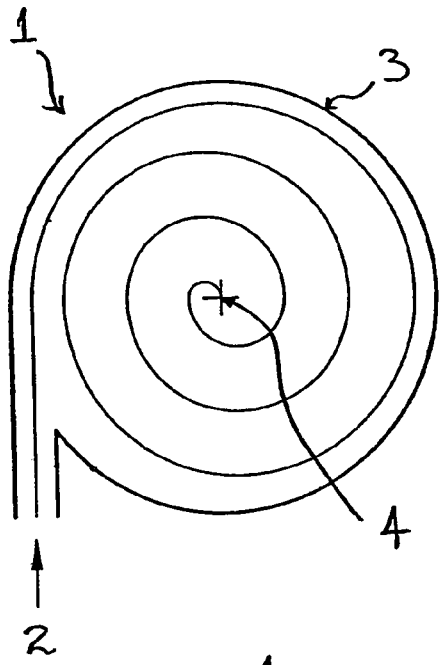
FIG. 1 is a schematic plan view of a prior art fluidic diode.
Figure 2:
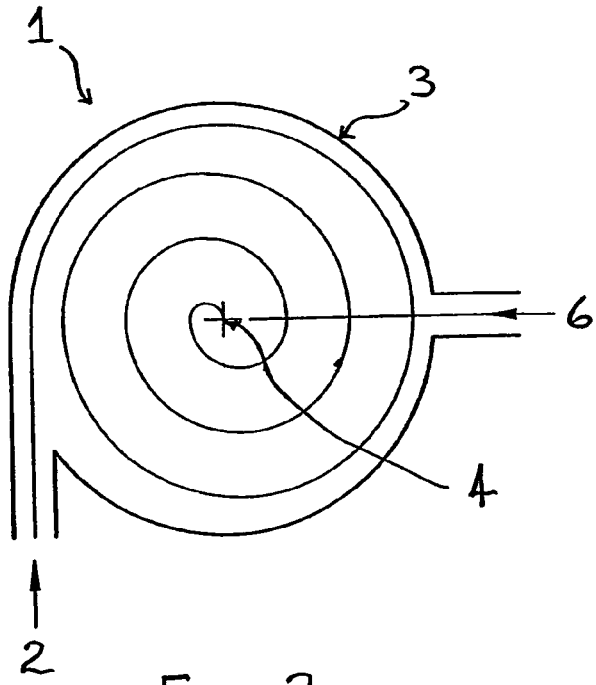
FIG. 2 is a schematic plan view of a prior art fluidic vortex amplifier.

In order to best describe the invention it is appropriate to describe prior art apparatus for regulating fluid flow as shown in FIGS. 1 and 2.

FIG. 1, depicts a schematic plan view of a "fluidic vortex diode" comprising a circular chamber 1 having a tangential inlet 2 in peripheral side wall 3. An outlet 4 at substantially 90 degrees to inlet 2 is located centrally on an end wall of chamber 1. Fluid entering inlet 2 follows a circular path that results in a vortex that has high resistance (drag). This is used as a "diode" in fluidic circuits.

FIG. 2 depicts a schematic plan view of a "fluidic vortex amplifier". Like that of the fluidic vortex diode shown in FIG. 1. it comprises a circular chamber 1 having a tangential inlet 2 in peripheral side wall 3. It also has an outlet 4 at substantially 90 degrees to inlet 2, which is located centrally on an end wall of chamber 1. Fluid entering inlet 2 also follows a circular path that results in a vortex that has high resistance (drag). However, it also has a control (or secondary) inlet 6. Flow through this control inlet 6 breaks down the vortex motion and effect, resulting in a gaining of flow. Such a control flow is used for "variable resistance" in fluidic circuits. In FIG. 2 the flow through control inlet 6 is substantially parallel to that of the circular (vortex) path of the primary flow entering through inlet 2. However, if control inlet 6 was relocated such that its input flow is perpendicular to the circular (vortex) path, rather than parallel it can be used to create an atomised jet effect of the type described earlier with respect to the "atomising disk" shown in FIG. 2 of U.S. Pat. No. 6,161,782. However, as mentioned previously this perpendicular input of the secondary flow breaks down the vortex rather than assisting it.

Figure 3:
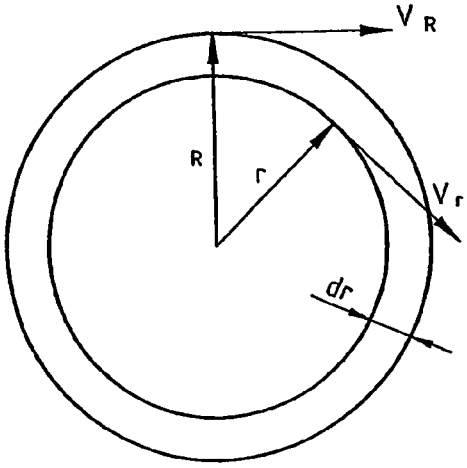
FIG. 3 is a schematic plan diagram for describing prior art vortex principle.

FIG. 3 is a schematic plan view of a very small section of change within chamber 1, to assist in describing the principle of a "vortex". The principle is described with reference to the following formulae:

$$V_r = V_R(r/R)^{\eta} \quad \text{A)}$$

R—outer radius r—inner radius $V_r$—vortex tangential velocity (on r)

$V_R$—vortex tangential velocity (on R)

η—viscosity constant (+1>η>−1)

where: η=+1 is a solid body,

η=−1 is viscosity free;

and 0>η>−1 is gaseous or liquid as all values for η are negative, $V_r$ can be expressed as the following:

$$V_r = V_R(R/r)^{\eta}$$

we also know that:

$$F = m[(V_r)^2/R)] \quad \text{B)}$$

along with:

$$d_p = S(V_r)^2\,(d_r/r) \quad \text{C)}$$

where: F—force m—mass $d_p$—change in pressure

S—density of liquid $d_r$—change in radius

Upon substitution and integration:

$$P_r = P_R + [S(V_R)^2/2\eta][(r/R)^{2\eta} - 1] \quad \text{D)}$$

where: $P_r$—Pressure (on r)

$P_R$—Pressure (on R)

This shows the state of the vortex, ie. as the fluid moves from the circumference to the centre, there is an increase in speed along with pressure. This application is already used in devices such as garden sprinkles. However, they result in a fimbriated spray pattern and have poor atomisation effects.

Figure 4:
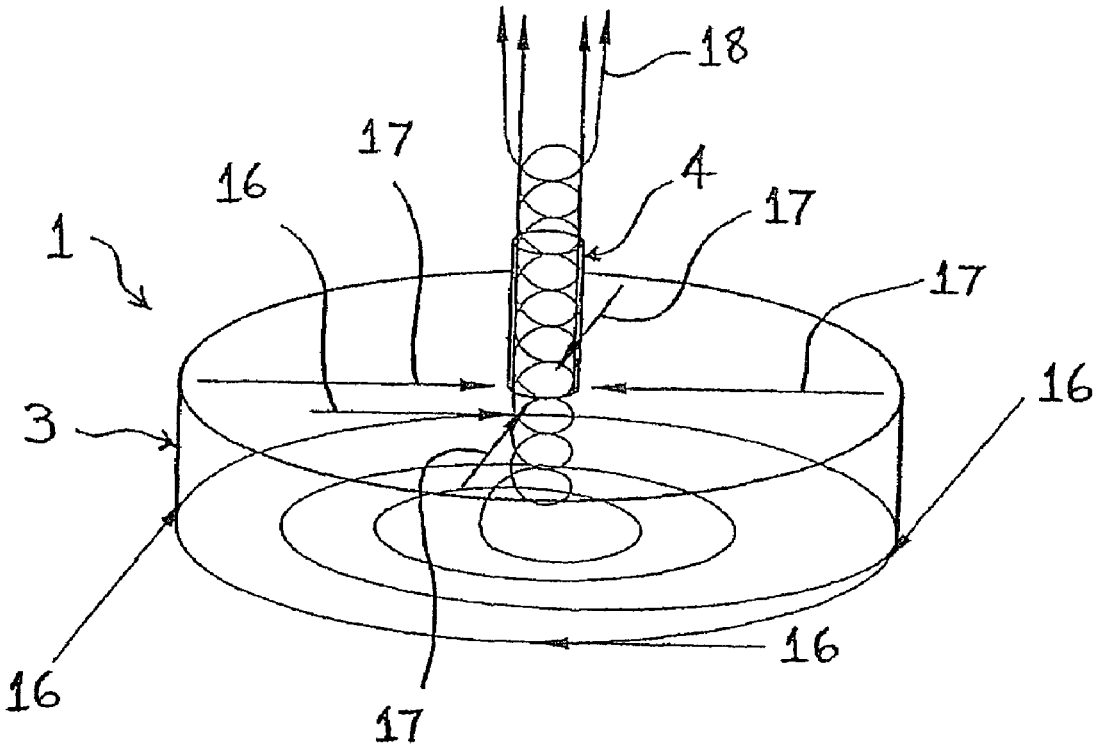
FIG. 4 is a schematic perspective view of a first embodiment of an apparatus for regulating fluid flow through a spray nozzle in accordance with the present invention.

FIG. 4 depicts a schematic perspective view of a first embodiment of an apparatus for regulating fluid flow through a spray nozzle in accordance with the present invention. The apparatus comprises a circular chamber 1 having a peripheral sidewall 3. Fluid flow passing through chamber 1 is divided into two layers, a primary lower layer 16 and a secondary upper layer 17. The primary lower layer 16 of flow enters chamber 1 from an inlet that is tangential to the peripheral sidewall 3 (or outer perimeter) to create a vortex motion to the centre. The secondary upper layer 17 enters the chamber 1 from an inlet that is perpendicular to the peripheral sidewall 3 (or outer perimeter) to create radial motion inwardly towards an outlet 4 at the centre that is substantially at 90 degrees to the tangential inlet.

The primary lower layer 16 and the secondary upper layer 17 interact (mix) and support each other in a non-destructive manner from start (perimeter) to finish (outlet). They do not break up the motion and effects created by the vortex, but rather enlarge and heighten the effects of the vortex. That is, as the layers 16 and 17 move from the outer perimeter (circumference) to the centre, there is an increase in pressure, drag and speed. It is preserved and built up in the form of potential energy, until it is released at the outlet in the form of kinetic energy, which we can see in the form of a centrifugal gush 18. The centrifugal gush 18 can be controlled and adjusted to produce various configurations to the outlet spray formation ie. straight line, wide angled, fimbriated, mist—full atomisation, single layered or stratified, point-blank pulse/hammering-etc., dependent on the nature of the desired end usage requirement.

Figure 5:
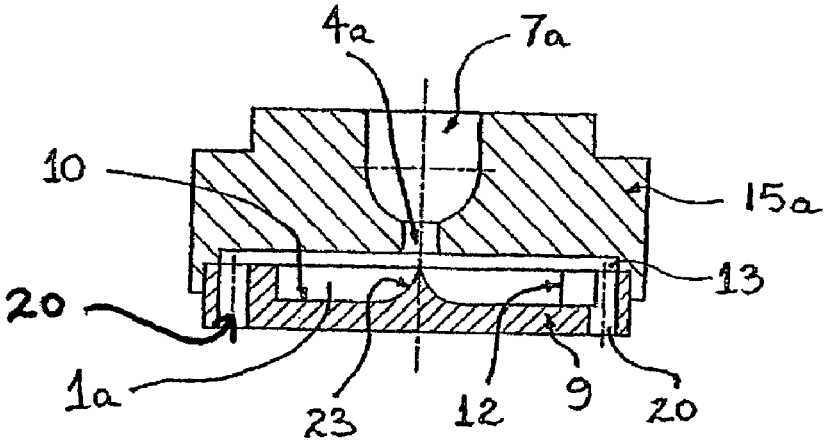
FIG. 5 is a schematic cross sectional view of a second embodiment of an apparatus for regulating fluid flow through a spray nozzle in accordance with the present invention.
Figure 6:
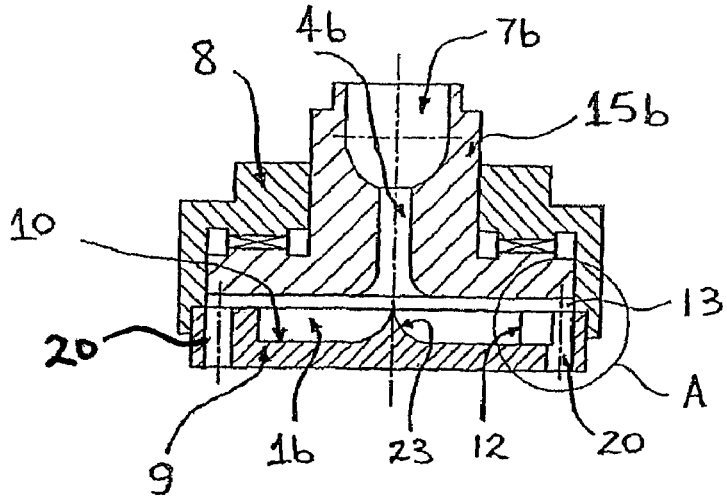
FIG. 6 is a schematic cross sectional view of a third embodiment of an apparatus for regulating fluid flow through a spray nozzle in accordance with the present invention.

FIGS. 5 and 6 depict second and third embodiments of a "shower head" apparatus for regulating fluid flow through a spray nozzle that produce the primary lower layer 16 and secondary upper layer 17 flow conditions described with reference to the first embodiment of the invention shown in FIG. 4. FIG. 5 depicts a shower head having a "fixed volume" circular chamber 1*a*, whilst FIG. 6 depicts a shower head having a "variable volume" circular chamber 1*b*.

Chamber 1*a* of the "fixed volume" shower head depicted in FIG. 5, is adapted to receive the water flow (not shown), and regulated atomised spray exits through a single hole nozzle 7*a*, fitted to chamber outlet 4*a* in shower housing 15*a*.

Chamber 1*b* of the "adjustable volume" shower head depicted in FIG. 6. is similar to that of the embodiment of FIG. 5, however, in this case the flow in chamber 1*b* may be adjusted by a user rotating an outlet nozzle housing 8, which in turn regulates the discharge volume and spray formation through outlet 4*b* in shower housing 15*b*, and nozzle 7*b*.

Figure 7:
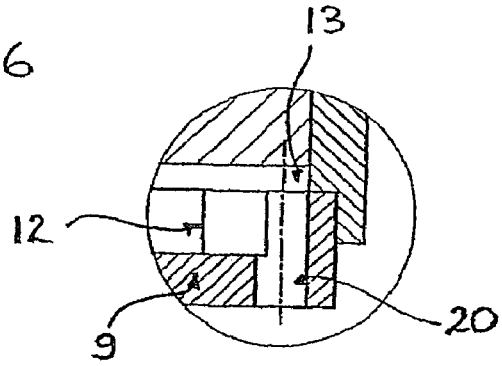
FIG. 7 is an enlarged detail of the apparatus shown in circle A of FIG. 6.
Figure 8:
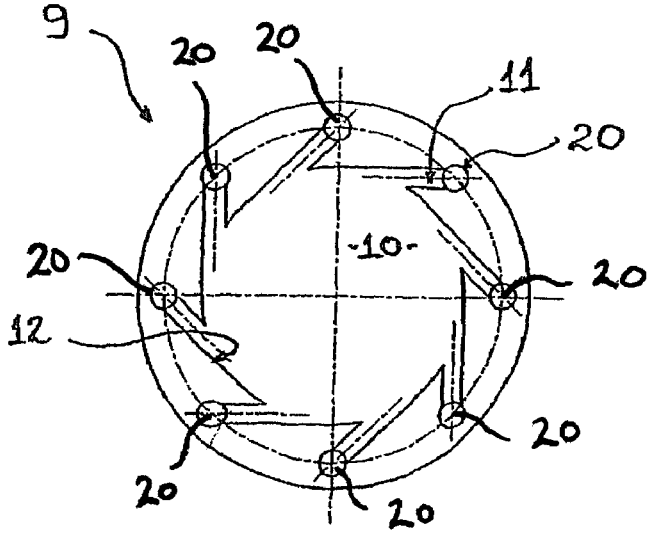
FIG. 8 is plan view of the disc used in the embodiments shown in FIGS. 5 and 6.

Both embodiments of FIGS. 5 and 6 comprise an internal disc 9, shown in FIG. 8 that is preferably used to form the aforementioned chambers 1*a* and 1*b* respectively. In each embodiment, disc 9 also distributes the flows into the chambers 1*a* or 1*b*. With these embodiments both flows enter the chamber through the face 10 of the disc 9. In use, the water flow enters tangentially through eight inlet ports 11 around peripheral side wall 12 of disc 9. A substantial portion of the flow develops into a primary lower layer, similar to 16, shown in FIG. 4. However, a portion of the flow as it passes through the eight apertures 20 associated with inlet ports 11 is urged circumferentially into the annular gap 13 between disc 9 and shower housing 15*a* or 15*b*. An enlarged view of gap 13, which is located radially outwardly relative to the peripheral side wall 12, is shown in FIG. 7. This flow then becomes a secondary upper layer, similar to 17, shown in FIG. 4, and proceeds radially inwardly towards outlet 4*a* or 4*b*. The spray characteristics of each shower head is determined by the fixed width of gap 13, as it sets the magnitude of the secondary upper (control) layer relative to the primary layer.

In the case of the "fixed volume" shower head as shown in FIG. 5, the annular gap 13 is also fixed thereby fixing its spray characteristics, however, in the case of "adjustable volume" shower head as shown in FIG. 6, the annular gap 13 is adjustable thereby allowing the spraying characteristics to be varied. This allows for the layers of flow 16 and 17 to be manipulated via a stepless control mechanism).

Figure 9:
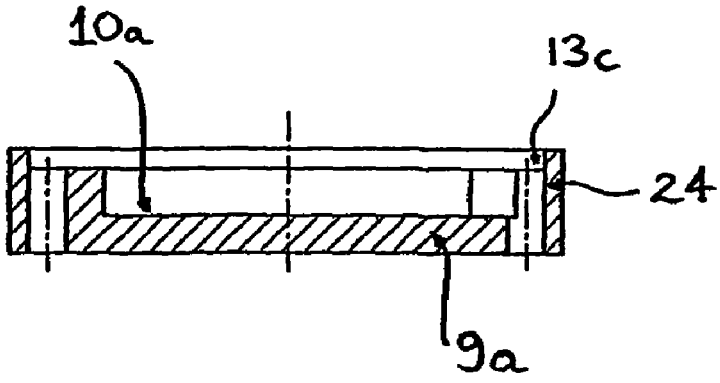
FIG. 9 is a schematic cross sectional view of a disc for use in a fourth embodiment of an apparatus for regulating fluid flow through a spray nozzle in accordance with the present invention.

The disc 9 shown in the second and third embodiments of FIGS. 5 and 6, has face 10 with a raised central portion 23 with a radially curved surface that directs the flow towards the chamber outlets 4 or 4*a*. A disc 9*a* that may be used in a fourth embodiment of the invention is shown in FIG. 9. Disc 9*a* is similar to disc 9, however its face 10*a* is flat.

Figure 10:
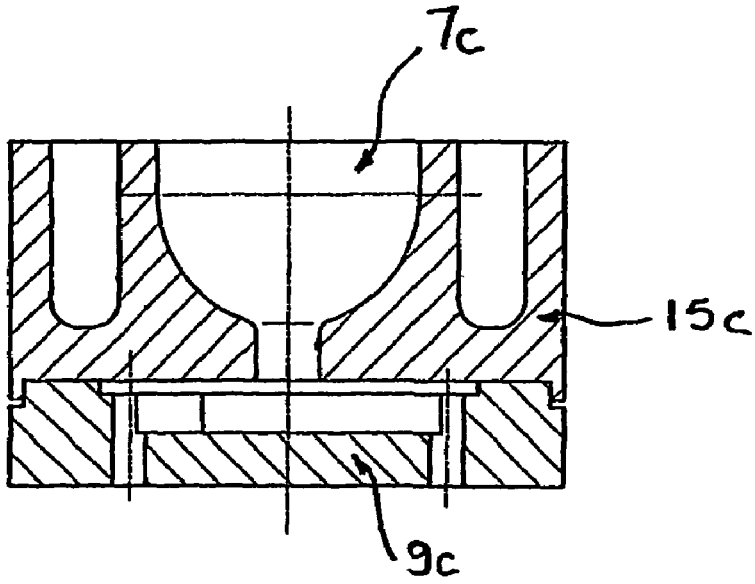
FIG. 10 is a schematic cross sectional view of a fifth embodiment of an apparatus for regulating fluid flow through a spray nozzle in accordance with the present invention.
Figure 11:
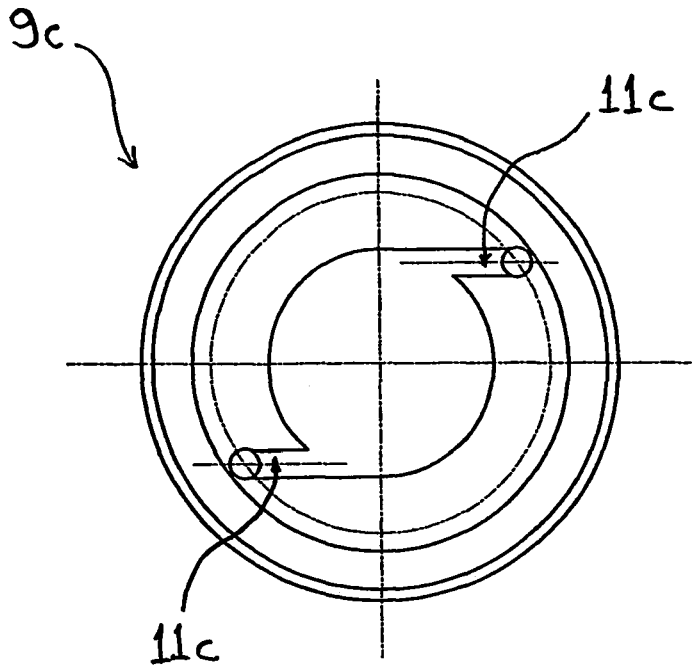
FIG. 11 is a plan view of the disc used in the embodiment shown in FIG. 10.

FIGS. 10 and 11 depict a fifth embodiment of an apparatus for regulating fluid flow through a spray nozzle suitable for use with a water tap. The housing 15*c* and disc 9*c* are insertable in a cartridge type arrangement into the free end of a water tap having a removable mesh outlet cover. This fifth embodiment has a "fixed volume" similar to the second embodiment "shower head" shown in FIG. 5. A single hole nozzle 7*c* is located in housing 15*c*, through which a regulated atomised spray exits. In this embodiment, disc 9*c* has two inlet ports 11*c* through which the flow enters. Like that of the earlier embodiments primary and secondary layers of flow 16 and 17 are established as water flows through the apparatus. The gap 13*c*, which in this embodiment generates the secondary layer of flow 17 is adjacent a peripheral side wall 12*c* which is part of the disc 9*c*.

Figure 12A:
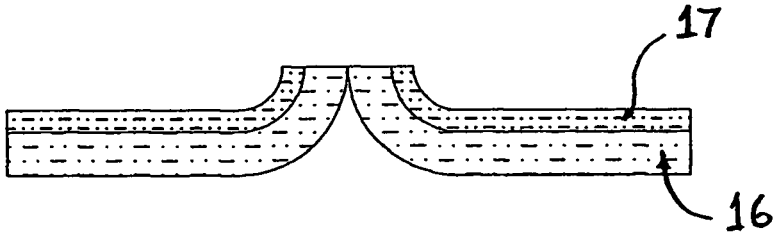
FIGS. 12A-C show various flow layer profiles that can be achieved with an apparatus for regulating fluid flow through a spray nozzle in accordance with the present invention.
Figure 12B:
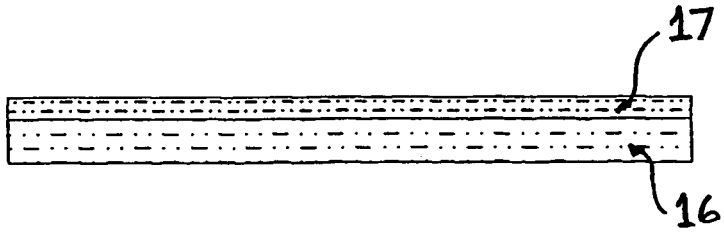
Figure 12C:
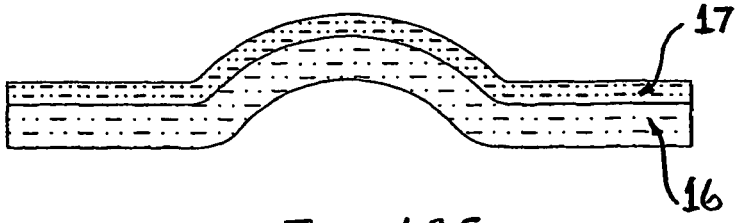

FIGS. 12A-C show three different flow layer profiles showing the relationship between a primary lower layer 16 and a secondary layer 17. The curved flow layer profile shown in FIG. 12A is that generated in the second and third embodiments by disc 9 shown in FIGS. 5 and 6. The parallel flow layer shown in FIG. 12B is that generated by the disc 9*a* of the fourth embodiment shown in FIG. 9. The curved flow layer profile shown in FIG. 12C is one that would be generated if the upper surface 10*a* of the disc 9*a* was convex rather than flat.

From tests conducted by the inventor the following advantages are apparent with shower heads constructed according to the abovementioned embodiments of the present invention.

- a reduced nozzle flow rate down to 2 litres per minute can be obtained at an increased constant pressure over the supply,
- the outlet nozzle flow remains constant and is self-regulating with little regard to the supply pressure to the shower head,
- the nozzle spray is finer and more uniform than that from current water saver shower heads,
- the shower spray at low flow rates feels more substantial than the spray emanating from current shower heads,
- the increased flow pressure and atomising created by the chamber vortex enables a single hole nozzle to be used which avoids problems of clogging even with hard water,
- the outlet nozzle flow and water temperature are not significantly affected by changes in supply pressure, and
- in the case of the "adjustable volume" shower head, stepless adjustment of the secondary control flow into the chamber by simple rotation of a shower head valve is able to vary the nozzle discharge, reduce water usage and alter the spray pattern without disruption of water flow, and
- no moving parts, thereby lengthening life of apparatus.

Whilst in the abovementioned embodiments the outlet centrally located, in other not shown embodiments the outlet does not have to be located at the centre of the chamber and may for instance be located near the centrally located axis. We positioning of the outlet can vary the output spray effect, and its location slightly offset from the central located can for instance be used to generate a pulse spray suitable for high pressure washing.

It should also be understood that plane of contact (or interface), between layers of flow 16 and 17 within chamber 1, can occur on various contours, such as parallel, concave, convex, parabolic, some on curved and some on a plane etc.

It should also be understood that whilst the abovementioned embodiments of the present invention refer to two layers of flow 16 and 17, it should be understood that in further not shown embodiments additional layers of flow may exist. Further layers may be of vortex and/or radial in the nature of their flows and may be separated by means of a physical barrier.

It will thus be appreciated that this invention at least in the form of the embodiments disclosed provides a novel and improved form of water saving shower head. Clearly however the examples described are only the currently preferred forms of the invention and a wide variety of modifications may be made which would be apparent to a person skilled in the art. For example the relative size of the circular chamber, the shape and configuration of the annular gap, the shape and configuration of the outlet nozzle, the placement number and design of the inlet ports, and the means of adjusting the control flow pressure may all be changed to suit applications other than shower heads following further development work by the inventor. It is also envisaged that the apparatus could be used as a mixer of different fluids. The invention is also not limited to any particular material for constructing the shower head although a high strength plastic or a corrosion resistant metal such as stainless steel or brass is currently preferred.

Whilst the present invention has been described with reference to shower head applications, it should be understood that the apparatus of the present invention is applicable to other not shown fluidic applications, such as, electronic fuel injection systems, exhaust systems, fire hydrant nozzles, sand-blasting nozzles, projectile firing devices, spray painting nozzles, bio-medical spray systems, brick-wash nozzles, aerosol bottle/can nozzles and gas torches.

In not shown embodiments where the apparatus of the present invention is used in sand-blasting nozzle or other projectile firing device, solids or projectiles are carried by the fluid flow. Where a fluid flow is established in a like manner to that show in FIG. 4, the centrifugal gush 18 may be used to control direction and stability of the flight path of the solids or projectiles being fired by the device.

It should also be understood that whilst the above described shower head embodiments have been described with the water as the fluid, it may in other not shown embodiments be another type of fluid, either liquid or gas or mixtures thereof. Such fluids for example may be fuel, paint, agricultural chemical solutions, cleaning agents, medications, or commercial gases such as oxygen and nitrogen. Furthermore, the apparatus of the present invention may be used to mix different fluids prior to spraying.

The claims defining the invention are as follows:

1. An apparatus for regulating fluid flow through a spray nozzle, said apparatus comprising:

(a) a circular chamber defined by spaced apart end walls;

(b) a peripheral side wall;

(e) a central axis;

(d) an inlet at or near said peripheral side wall to allow a flow of fluid to enter said chamber substantially tangential to said peripheral side wall;

(e) an outlet exiting through one of said end walls wherein in use a flow of fluid entering through said inlet has a primary lower layer that substantially follows a first circular flow path which forms a vortex commencing at or near said peripheral side wall and increases in velocity and pressure towards said outlet; and (f) at least one secondary upper layer that substantially follows a second flow path radially inwardly towards said central axis, wherein said primary lower layer and said secondary upper layer interact and support each other in a non-destructive manner from peripheral side wall to said outlet.

2. An apparatus for regulating fluid flow through a spray nozzle as claimed in claim 1, wherein said second flow path of said secondary upper layer is generated by means for generating an inwardly radial flow.

3. An apparatus for regulating fluid flow through a spray nozzle as claimed in claim 2, wherein said apparatus comprises a disc engagable with a spray nozzle housing that in combination define said circular chamber, and one of said spaced apart end walls and said peripheral side wall of said circular chamber form part of said disc, and said means for generating an inwardly radial flow is a narrow annular gap between said disc and said housing, said narrow annular gap being disposed radially outwardly relative to said peripheral side wall.

4. An apparatus for regulating fluid flow though a spray nozzle as claimed in claim 3, wherein the volume of said annular gap is fixed.

5. An apparatus for regulating fluid flow through a spray nozzle as claimed in claim 3, wherein the volume of said narrow annular gap is adjustably varied by movement of said disc relative to said spray nozzle housing along said centrally located housing.

6. An apparatus for regulating fluid flow through a spray nozzle as claimed in claim 1, wherein said outlet is located at or near said centrally located axis.

7. An apparatus for regulating fluid flow through a spray nozzle as claimed in claim 1, wherein said inlet is a plurality of inlets.

8. An apparatus for regulating fluid flow through a spray nozzle as claimed in claim 7 wherein said apparatus is a shower head.

9. An apparatus for regulating fluid flow as claimed in claim 3 wherein the one of said spaced apart end walls that forms part of said disc has a substantially flat portion.

10. An apparatus for regulating fluid flow as claimed in claim 3 wherein the one of said spaced apart end walls that forms part of said disc has at least one substantially curved portion.

11. An apparatus for regulating fluid flow as claimed in claim 1 wherein said apparatus is used to mix different fluids.

* * * * *